US006209546B1

(12) United States Patent
Baehl et al.

(10) Patent No.: US 6,209,546 B1
(45) Date of Patent: Apr. 3, 2001

(54) APPARATUS AND METHOD FOR IMPROVED HYDRATE FORMATION AND IMPROVED EFFICIENCY OF RECOVERY OF EXPANSION AGENT IN PROCESSES FOR EXPANDING TOBACCO AND OTHER AGRICULTURAL PRODUCTS

(75) Inventors: Donald A. Baehl, Simpsonville, SC (US); Jack B. Knight, Céret (FR); Truman W. Ellison, 1202 Bell Rd., Belton, SC (US) 29627

(73) Assignee: Truman W. Ellison, Belton, SC (US)

( * ) Notice: Subject to any disclaimer, the term of this patent is extended or adjusted under 35 U.S.C. 154(b) by 0 days.

(21) Appl. No.: 09/203,199

(22) Filed: Nov. 30, 1998

(51) Int. Cl.[7] ..... A24B 3/18; A24B 3/10; A24B 1/02

(52) U.S. Cl. ..... 131/291; 131/300; 131/901; 131/290; 131/309; 131/310

(58) Field of Search ..... 131/291, 296, 131/300, 302, 900, 901, 290, 309, 310; 55/338; 426/445

(56) References Cited

U.S. PATENT DOCUMENTS

| | | | |
|---|---|---|---|
| 3,693,631 | 9/1972 | Moore et al. . | |
| 3,754,407 | 8/1973 | Tyree, Jr. . | |
| 4,086,784 | 5/1978 | Wagner . | |
| 4,165,618 | 8/1979 | Tyree, Jr. . | |
| 4,235,250 | 11/1980 | Utsch . | |
| 4,250,898 | 2/1981 | Utsch et al. . | |
| 4,258,729 | 3/1981 | de la Burde et al. . | |
| 4,308,876 | 1/1982 | Rothchild . | |
| 4,336,814 | 6/1982 | Sykes et al. . | |
| 4,340,073 | 7/1982 | de la Burde et al. . | |
| 4,377,173 | 3/1983 | Rothchild . | |
| 5,020,550 | 6/1991 | Uchiyama et al. | 131/296 |
| 5,076,293 | 12/1991 | Kramer . | |
| 5,143,096 | 9/1992 | Steinberg . | |
| 5,259,403 | 11/1993 | Guy et al. . | |
| 5,311,885 | 5/1994 | Yoshimoto et al. . | |
| 5,365,950 | 11/1994 | Yoshimoto et al. . | |
| 5,711,319 | 1/1998 | Cumner . | |
| 5,819,754 | 10/1998 | Conrad et al. . | |

FOREIGN PATENT DOCUMENTS

| | | |
|---|---|---|
| 0 500 226 A1 | 8/1992 | (EP) . |
| 1 484 536 | 1/1975 | (GB) . |
| 0 514 860 A2 | 11/1992 | (JP) . |

*Primary Examiner*—Stanley S. Silverman
*Assistant Examiner*—Dionne A. Walls
(74) *Attorney, Agent, or Firm*—Caesar, Rivise, Bernstein, Cohen & Pokotilow, Ltd.

(57) ABSTRACT

An apparatus and a method for recovering additional expansion agent in a process for the expansion of tobacco or another agricultural product are disclosed. One embodiment is a method for recovering additional expansion agent in a process for the expansion of tobacco or another agricultural product, the process having a multi-step depressurization sequence including at least first and second depressurization steps for depressurizing an impregnation vessel, which includes the following steps: withdrawing substantially all of an amount of an expansion agent in the impregnation vessel at about the end of the second depressurization step during the multi-step depressurization sequence; and transmitting at least a portion of said amount of expansion agent to a low-pressure gas tank. In one embodiment, the expansion agent is carbon dioxide.

13 Claims, 3 Drawing Sheets

APPARATUS AND METHOD FOR IMPROVED HYDRATE FORMATION AND IMPROVED EFFICIENCY OF RECOVERY OF EXPANSION AGENT IN PROCESSES FOR EXPANDING TOBACCO AND OTHER AGRICULTURAL PRODUCTS

FIELD OF THE INVENTION

The present invention relates to processes and systems for expanding an agricultural product such as tobacco, food, or other such material by impregnating the product with an expansion agent under conditions of elevated pressure and at the saturation temperature of the expansion agent and thereafter exposing the impregnated product to conditions promoting expansion of an expanding agent. More particularly, the present invention relates to a method and an apparatus for recovering additional amounts of carbon dioxide or another such expansion agent in such processes or systems, which method and apparatus result in improved hydrate formation and improved efficiency in the recovery of the carbon dioxide or other such expansion agents.

BACKGROUND OF INVENTION

As discussed in U.S. Pat. No. 5,143,096 (Steinberg), a number of methods are known for expanding cellular materials, including tobacco and other agricultural products. In general, these methods involve introducing an expansion agent, i.e., a substance capable of undergoing expansion, as by a phase change from a liquid to a gas, into the cells of the material and causing the agent to expand.

It also is known to expand cellular material by impregnating it with a liquefied gas expansion agent, such as liquefied carbon dioxide, at an elevated pressure; removing excess expanding agent from the cellular material; reducing the pressure in which the cellular material is contained, thereby causing the expansion agent to solidify; and heating the cellular material, such as by exposure to a hot gas stream, e.g., steam, air, etc., to cause the solidified expansion agent to evaporate or sublime. The solidified expansion agent vaporizes at a rate greater than the rate at which the agent in gaseous form can escape from the cellular material. As a result of this treatment, the material is forced to expand.

The use of carbon dioxide as an expansion agent for expanding tobacco also is discussed in U.S. Pat. No. 4,235,250 (Utsch); U.S. Pat. No. 4,258,729 (de la Burde et al.); and U.S. Pat. No. 4,336,814 (Sykes et al.), among others. In the processes disclosed in those patents, carbon dioxide, either in gas or liquid form, is contacted with tobacco for impregnation, and thereafter the impregnated tobacco is subjected to rapid heating conditions to volatilize the carbon dioxide and thereby expand the tobacco.

U.S. Pat. No. 4,340,073 (de la Burde et al.) discloses a process and apparatus for expanding tobacco by impregnating the tobacco with carbon dioxide under conditions such that the carbon dioxide in contact with the tobacco is in liquid form, removing excess liquefied carbon dioxide from the tobacco, reducing the pressure of the impregnated tobacco to solidify carbon dioxide within the tobacco structure, and rapidly heating the tobacco at atmospheric pressure to vaporize the carbon dioxide and expand the tobacco.

U.K. Patent Specification 1,484,536 (Michals) discloses a method for expanding an organic substance, such as tobacco, using liquid carbon dioxide. The method comprises the steps of pressurizing a vessel containing the substance to be expanded to a pressure in the range of about 200 to 1,070 psi with carbon dioxide, immersing the substance in liquid carbon dioxide while maintaining the pressure within the vessel, thereby impregnating the substance with the liquid carbon dioxide, removing excess liquid carbon dioxide from the impregnation vessel, depressurizing the vessel to substantially atmospheric pressure, thereby causing liquefied carbon dioxide on and in the substance to solidify, removing the impregnated substance from the vessel, and heating the substance to cause expansion of the substance by at least 10%. In this method, the carbon dioxide used to pressurize the impregnation vessel is taken from the vapor space of the process vessel that is used to provide liquid carbon dioxide to the impregnation chamber. After removal of the liquid carbon dioxide from the impregnation chamber, the carbon dioxide residue gas in the impregnation chamber is vented to the atmosphere or to a carbon dioxide recovery system (which is not shown in that patent specification).

Various types of recovery systems for carbon dioxide and other expansion agents (e.g., propane) used in tobacco expansion processes are disclosed in the prior art, as discussed below.

U.S. Pat. No. 4,165,618 (Tyree, Jr.) discloses a process for treating products, such as tobacco, using a liquid cryogen, such as liquefied carbon dioxide. In this process, a vessel in which the tobacco is impregnated is purged and pressurized by transferring gas from the vapor space of a liquid cryogen storage vessel to the impregnating vessel. Subsequent to pressurization, liquid cryogen is transferred to the impregnation vessel from the liquid storage vessel. The tobacco is permitted to soak in the liquid cryogen for a predetermined time period, after which it is returned to the liquid storage vessel. The gaseous cryogen remaining in the impregnation vessel after removal of the liquid cryogen is then transferred to a series of accumulators from which the gas is compressed and eventually returned to a main reservoir for the liquid cryogen.

U.S. Pat. No. 5,365,950 (Yoshimoto, et al.) discloses an apparatus for expanding tobacco which uses carbon dioxide as an expansion agent and recycles the carbon dioxide using a pressure swing absorption (PSA) apparatus. The PSA apparatus is used as a recovery/separation unit to separate air (an impurity gas) from the recovered carbon dioxide. The carbon dioxide is then compressed to a higher pressure and supplied to an impregnating vessel. Several alternative embodiments are described which utilize one or more compressors to increase the pressure of the recovered carbon dioxide.

U.S. Pat. No. 5,311,885 (Yoshimoto, et al.) discloses another apparatus for expanding tobacco which uses carbon dioxide as an expansion agent and recycles the carbon dioxide using a PSA apparatus for recovery/separation of the carbon dioxide, similar to that in U.S. Pat. No. 5,365,950.

U.S. Pat. No. 5,711,319 (Cumner) discloses a process for the expansion of tobacco using carbon dioxide. Carbon dioxide gas discharged from an impregnator vessel during the depressurization step is collected within a carbon dioxide recovery balloon. Gas within the recovery balloon is recompressed using a compressor and is reliquified by a heat exchanger before being returned to a process vessel. The carbon dioxide reservoir is recharged with carbon dioxide gas directly from the compressor. Alternatively, carbon dioxide gas discharged from the impregnator vessel during the depressurization step is collected within an intermediate pressure vessel which conserves the pressure of a portion of the vented gas, the remainder being discharged to the recovery balloon. Preferably, a compressor is provided to transfer gas from the recovery balloon to the intermediate pressure vessel and a second compressor is used to transfer gas to a heat exchanger. Reliquified carbon dioxide from the heat exchanger is then returned to the processed vessel. The gas to recharge the reservoir with carbon dioxide is obtained directly from the second compressor.

U.S. Pat. No. 5,819,754 (Conrad, et al.) discloses an apparatus and processes for expanded tobacco with an expansion agent, such as propane. Following a predetermined impregnation period, some of the expansion agent is released from the impregnation zone to an accumulator for recycling. (The propane that is recycled back to the accumulator is used in subsequent tobacco treatment cycles.) An expansion agent recovery line is provided to further remove propane that remains in the impregnation zone and is not recycled due to equalization of pressures in the accumulator and chamber. It also provides for periodic removal of high-pressure expansion agent from the impregnation zone so that contaminants (e.g., moisture, etc.) do not build up to undesirable levels in the expansion agent. The expansion agent recovery line is connected to an optional gas recovery or disposable zone (not shown in the patent) for recovery of expansion agent or recovery of energy therefrom.

The tobacco expanding apparatuses may be classified generally into batch-type expanding apparatuses and continuous-type expanding apparatuses. In a typical batch-type expanding apparatus, a predetermined amount of tobacco material is stored in an impregnating vessel, high-pressure carbon dioxide is supplied to the impregnating vessel to impregnate the tobacco material with carbon dioxide, and thereafter the tobacco material is removed, thereby expanding the tobacco material. In a continuous-type expanding apparatus, the tobacco material and carbon dioxide are continuously supplied to an impregnating vessel.

Although the batch-type apparatus has a simple structure, its efficiency is low and a large amount of carbon dioxide is lost. The latter continuous-type expanding apparatus supposedly is more efficient and can recover and reuse carbon dioxide, as indicated in the discussion above for the patents issued to Yoshimoto, et al.—U.S. Pat. Nos. 5,311,885 and 5,365,950.

Many of the conventional processes, including the dry ice expanded tobacco (DIET) process and other carbon dioxide expansion processes, do not recover and reuse all of the available expansion agent (e.g., carbon dioxide), some of which is vented to the atmosphere. In addition to increased emissions to the environment, this results in less than ideal performance of the processes in terms of efficiency and economics.

It is desired to have an improved process and system for the expansion of agricultural products, such as tobacco, food, or other such materials, which overcome the disadvantages of the prior art.

It is further desired to have a more efficient and economic process and system for the expansion of agricultural products, such as tobacco, food, or other such materials.

It is still further desired to have an improved process and system for the expansion of agricultural products, such as tobacco, food, or other such materials which use carbon dioxide as the expansion agent.

It is still further desired to have an improved process and system for expanding agricultural products such as tobacco, food, or other such materials having an improved method and an apparatus for recovering additional amounts of carbon dioxide or another such expansion agent in such process or system.

It is still further desired to have an improved process and system for expanding agricultural products, such as tobacco, food, or other such materials having improved hydrate formation means which results in better expansion of the product and more uniformity of the expansion.

BRIEF SUMMARY OF THE INVENTION

The present invention is a method and an apparatus for recovering additional expansion agent in a process for the expansion of tobacco or another agricultural product, like food or other cellular products. The present invention includes a process for the expansion of tobacco or another agricultural product, wherein the process includes a method for recovering additional expansion agent. The present invention also includes an expanded tobacco product or another product produced in accordance with the process. In addition, the present invention includes a system for the expansion of tobacco or another agricultural product, wherein the system includes an apparatus for recovering additional expansion agent.

A first embodiment of the invention is a method for recovering additional expansion agent in a process for the expansion of tobacco or another agricultural product, the process having a multi-step depressurization sequence including at least first and second depressurization steps for depressurizing an impregnation vessel, comprising the steps of: withdrawing all of an amount of an expansion agent in the impregnation vessel at about the end of the second depressurization step during the multi-step depressurization sequence; and transmitting at least a portion of said amount of expansion agent to a low-pressure gas tank.

A second embodiment of the invention is a method for recovering additional expansion agent which includes the following additional steps: withdrawing at least a portion of the expansion agent from the low-pressure gas tank; compressing the expansion agent withdrawn from the low-pressure gas tank; transmitting the compressed expansion agent to a high-pressure gas tank; withdrawing at least a portion of the compressed expansion agent from the high-pressure gas tank; compressing further the compressed expansion agent withdrawn from the high-pressure gas tank; condensing the further compressed expansion agent; and storing the condensed expansion agent in a storage tank.

A third embodiment is a method for recovering additional expansion agent in a process for the expansion of tobacco or another agricultural product, the process having a multi-step depressurization sequence including at least first and second depressurization steps for depressurizing an impregnation vessel, comprising the steps of: withdrawing substantially all of an amount of expansion agent in the impregnation vessel at about the end of the second depressurization step during the multi-step depressurization sequence; and compressing at least a portion of said amount of expansion agent to a pressure sufficient to condense the expansion agent.

A fourth embodiment has two steps in addition to the steps in the third embodiment. The additional steps are to condense the compressed expansion agent, and to store the condensed expansion agent in a storage tank.

A fifth embodiment has one step in addition to the steps in the fourth embodiment. The additional step is to regulate a mass flow of said amount of expansion agent withdrawn from an impregnation vessel at a mass flow rate sufficient for maximum hydration of an amount of water in the tobacco or another agricultural product.

A sixth embodiment is a method for recovering additional expansion agent as in the third embodiment, but includes the additional step of determining an optimum depressurization mass flowrate for maximum hydrate formation over a range of pressures of depressurization from an initial impregnation pressure to a pressure where the expansion agent ceases to form water hydrate. In one variation, this additional step comprises the following sub-steps: (a) setting the mass flowrate of the expansion agent at a selected mass flowrate; (b) determining an amount of expanding agent present in an impregnated product at about the end of an impregnation cycle; (c) adjusting by an incremental amount the mass flowrate of the expansion agent; and (d) repeating sub-steps (b), (c) and (d) until a maximum amount of expanding agent is determined to be present in the impregnated product.

A seventh embodiment of the invention is a process for the expansion of tobacco or another agricultural product wherein the process includes a method for recovering additional expansion agent as in the first embodiment.

An eighth embodiment is a process for the expansion of tobacco or another agricultural product wherein the process includes a method for recovering additional expansion agent as in the third embodiment.

A ninth embodiment is an apparatus for recovering additional expansion agent in a process for the expansion of tobacco or another agricultural product, the process having a multi-step depressurization sequence including at least first and second depressurization steps for depressurizing an impregnation vessel, which includes: means for withdrawing substantially all of an amount of expansion agent in the impregnation vessel at about the end of the second depressurization step during the multi-step depressurization sequence; and means for transmitting at least a portion of said amount of expansion agent to a low-pressure gas tank.

A tenth embodiment of the invention is an apparatus for recovering additional expansion agent as in the ninth embodiment, but includes the following additional elements: means for withdrawing at least a portion of the expansion agent from the low-pressure gas tank; means for compressing the expansion agent withdrawn from the low-pressure gas tank; means for transmitting the compressed expansion agent to a high-pressure gas tank; means for withdrawing at least a portion of the compressed expansion agent from the high-pressure gas tank; means for compressing further the compressed expansion agent withdrawn from the high-pressure gas tank; means for condensing the further compressed expansion agent; and means for storing the condensed expansion agent in a storage tank.

An eleventh embodiment is an apparatus for recovering additional expansion agent in a process for the expansion of tobacco or another agricultural product, the process having a multi-step depressurization sequence including at least first and second depressurization steps for depressurizing an impregnation vessel, including: means for withdrawing substantially all of an amount of an expansion agent of the impregnation vessel at about the end of the second depressurization step during the multi-step depressurization sequence; and means for compressing at least a portion of said amount of expansion agent to a pressure sufficient to condense the expansion agent.

A twelfth embodiment is an apparatus for recovering additional expansion agent as in the eleventh embodiment, but includes the following additional elements: means for condensing the compressed expansion agent; and means for storing the condensed expansion agent in a storage tank.

A thirteenth embodiment of the invention is an apparatus for recovering additional expansion agent as in the eleventh embodiment, but includes the additional element of means for regulating a mass flow of said amount of expansion agent withdrawn from the impregnation vessel at a mass flow rate sufficient for maximum hydration of an amount of water in the tobacco or other agricultural product.

A fourteenth embodiment is an apparatus for recovering additional expansion agent as in the eleventh embodiment, but includes the additional element of a means for determining an optimum depressurization mass flow for maximum hydrate formation over a range of pressures of depressurization from an initial impregnation pressure to a pressure where the expansion agent ceases to form water hydrate.

A fifteenth embodiment of the invention is a system for the expansion of tobacco or another agricultural product wherein the system includes an apparatus for recovering additional expansion agent as in the ninth embodiment.

A sixteenth embodiment of the invention is a system for the expansion of tobacco or another agricultural product wherein the system includes an apparatus for recovering additional expansion agent as in the eleventh embodiment.

A seventeenth embodiment of the invention is an apparatus as in the thirteenth embodiment, wherein the means for regulating comprises: a flow control valve in communication with a conduit adapted for transmitting the mass flow of said amount of the expansion agent withdrawn from the impregnation vessel to the means for compressing; a differential flow metering device in communication with the flow control valve and with the means for compressing; and a set-point controller in communication with the flow control valve and a differential flow metering device.

Another aspect of the present invention is an expanded tobacco product or another product produced in accordance with the process of the seventh embodiment.

Yet another aspect of the invention is an expanded tobacco product or another product produced in accordance with the process of the eighth embodiment.

In any of the embodiments and aspects of the invention discussed above, the expansion agent may be carbon dioxide ($CO_2$). However, expansion agents other than carbon dioxide may be used, including but not limited to the list of expansion agents set forth in the discussion of the Detailed Description of the Invention and in the appended Claims.

BRIEF DESCRIPTION OF THE DRAWINGS

For a better understanding of the present invention, reference is made to the accompanying drawings. The drawings show several embodiments of the invention as presently preferred. It should be understood, however, that the invention is not limited to the arrangements and instrumentalities shown in the drawings.

DETAILED DESCRIPTION OF THE INVENTION

Several embodiments of the present invention are discussed herein with respect to processes for the production of expanded tobacco which use carbon dioxide ($CO_2$) as an expansion agent. However, the invention is not limited to expanded tobacco, but is adaptable to other processes and systems for the production of other expanded cellular and/or agricultural products, including but not limited to foods. Also, other expansion agents may be utilized in the present invention instead of carbon dioxide, including but not limited to the following: ethylene ($C_2H_2$), propylene ($C_3H_6$), cyclo propane ($C_3H_6$), propane ($C_3H_8$), iso-butane ($C_4H_{10}$), shlorine ($Cl_2$), hydrogen sulfide ($H_2S$), nitrogen ($N_2$), oxygen ($O_2$), methane ($CH_4$), acetylene($C_2H_2$), ethane ($C_2H_6$), methyl iodide ($CH_3I$), argon (A), arsine ($AsH_3$), bromine ($Br_2$), bromine chloride (Br Cl), chlorine dioxide (Cl $O_2$), hydrogen selenide ($H_2$ Se), krypton (Kr), methyl hydro sulfide($CH_3$ HS), nitrous oxide ($N_2O$), phosphine ($PH_3$), sulfur dioxide ($SO_2$), sulfur hexafluoride ($SF_6$), sulfuryl chloride ($SO_2Cl_2$), stibine (Sb $H_3$), and xenon (Xe).

In addition, refrigerants could be used in the present invention as an expansion agent, including but not limited to the following: F-11 ($CCl_3F$), F-12 ($CCl_2$ $F_2$), F-12B1 (CCl $F_2$ Br), F-13B1 (CBr $F_3$), F-20 (CH $Cl_3$), F-21 (CH $Cl_2$ F), F-22 (CH Cl $F_2$), F-30 ($CH_2$ $Cl_2$), F-31 ($CH_2$ Cl F), F-32 ($CH_2$ $F_2$), F-40 ($CH_3$ Cl), F-40B1 ($CH_3$ Br), F-142b ($CH_3$ CCl $F_2$), F-152a ($CH_3$ $CHF_2$), F-12B2($CF_2$ $Br_2$), F-22B1 (CH Br $F_2$), F-41($CH_3$ F), F-150a ($CH_3$ CH $Cl_2$), F-160 ($C_2H_5$ Cl), F-160B1 ($C_2H_5$ Br), F-161 ($C_2H_5$ F), and F-1140 ($CH_2$=CHCl).

In the carbon dioxide expansion process, the production of expanded tobacco utilizes carbon dioxide ($CO_2$) as the expansion agent or impregnant. The impregnant, when placed in contact with the tobacco under the appropriate conditions of temperature and pressure, forms an expanding agent (e.g., $CO_2$ hydrate) in the tobacco. (Note that the "$CO_2$ hydrate" is referred to as the "expanding agent", while $CO_2$ is the "expansion agent", sometimes referred to as the "impregnant".) When the impregnated tobacco is subjected to rapid heating, the expanding agent decomposes to release substantial quantities of gases, which expand the tobacco cells.

Figure 1:
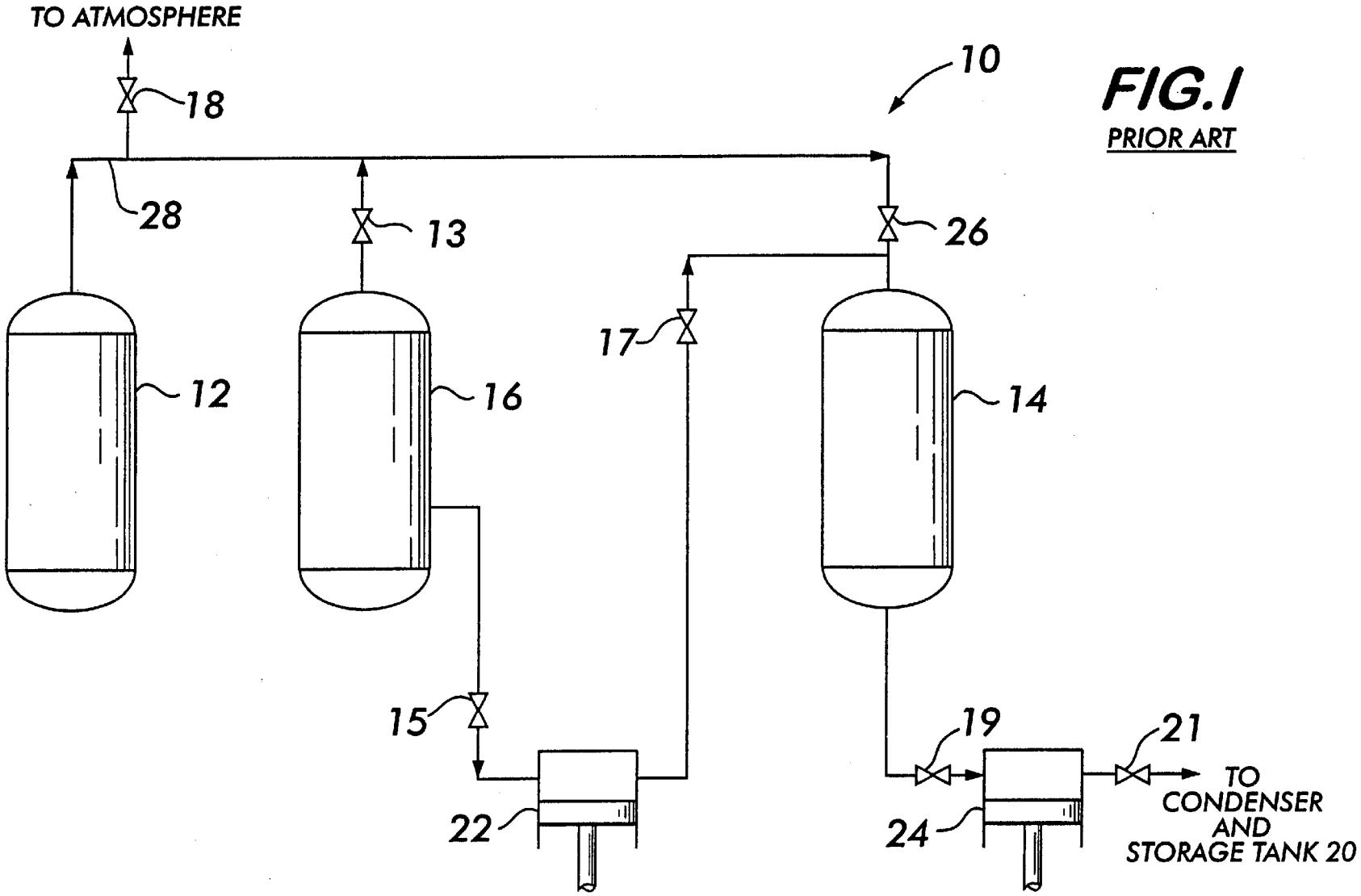
FIG. 1 PRIOR ART
FIG. 1 is a schematic representation illustrating a process flow diagram for a conventional carbon dioxide recovery method used in the production of expanded tobacco.

FIG. 1 illustrates a conventional carbon dioxide recovery process and apparatus 10 for the carbon dioxide expansion process. Due to the physical properties of carbon dioxide, the contacting of the tobacco and liquid carbon dioxide must be carried out in an impregnation vessel 12 under high-pressure conditions. After sufficient contact time has elapsed, the liquid carbon dioxide in the impregnation vessel is drained and the impregnation vessel is depressurized.

The depressurization process is usually carried out in three steps (although a two-step process is conceivable, and more than three steps may be used). Referring to FIG. 1, the depressurization sequence involves a first depressurization step where the carbon dioxide gas is allowed to expand and flow to a high-pressure gas tank 14, followed by a second depressurization step to a low-pressure gas tank 16. In a third depressurization step, the carbon dioxide in the impregnation vessel 12 is vented to the atmosphere via valve 18. As a result of the third depressurization step, all of the remaining available carbon dioxide present in the impregnation vessel at the completion of the second depressurization step is lost.

To recover the carbon dioxide present in the high-pressure gas tank 14 and the low-pressure gas tank 16 as a result of the first two depressurization steps, the carbon dioxide gas is compressed to a sufficient pressure where it is condensed and stored for subsequent reuse in a high-pressure liquid storage tank 20 (not shown), as indicated in FIG. 1. To compress the carbon dioxide gas to the condensation pressure, a low-pressure gas compressor 22 is used to pump the low-pressure gas from the low-pressure gas tank 16 to the high-pressure gas tank 14 via valves 15 and 17. A high-pressure gas compressor 24 is used to pump the high-pressure gas via valve 19 from the high-pressure gas tank 14 to a condenser (not shown) via valve 21. After condensation, the recovered liquid is provided for storage in the high-pressure liquid storage tank 20 (not shown).

Figure 2:
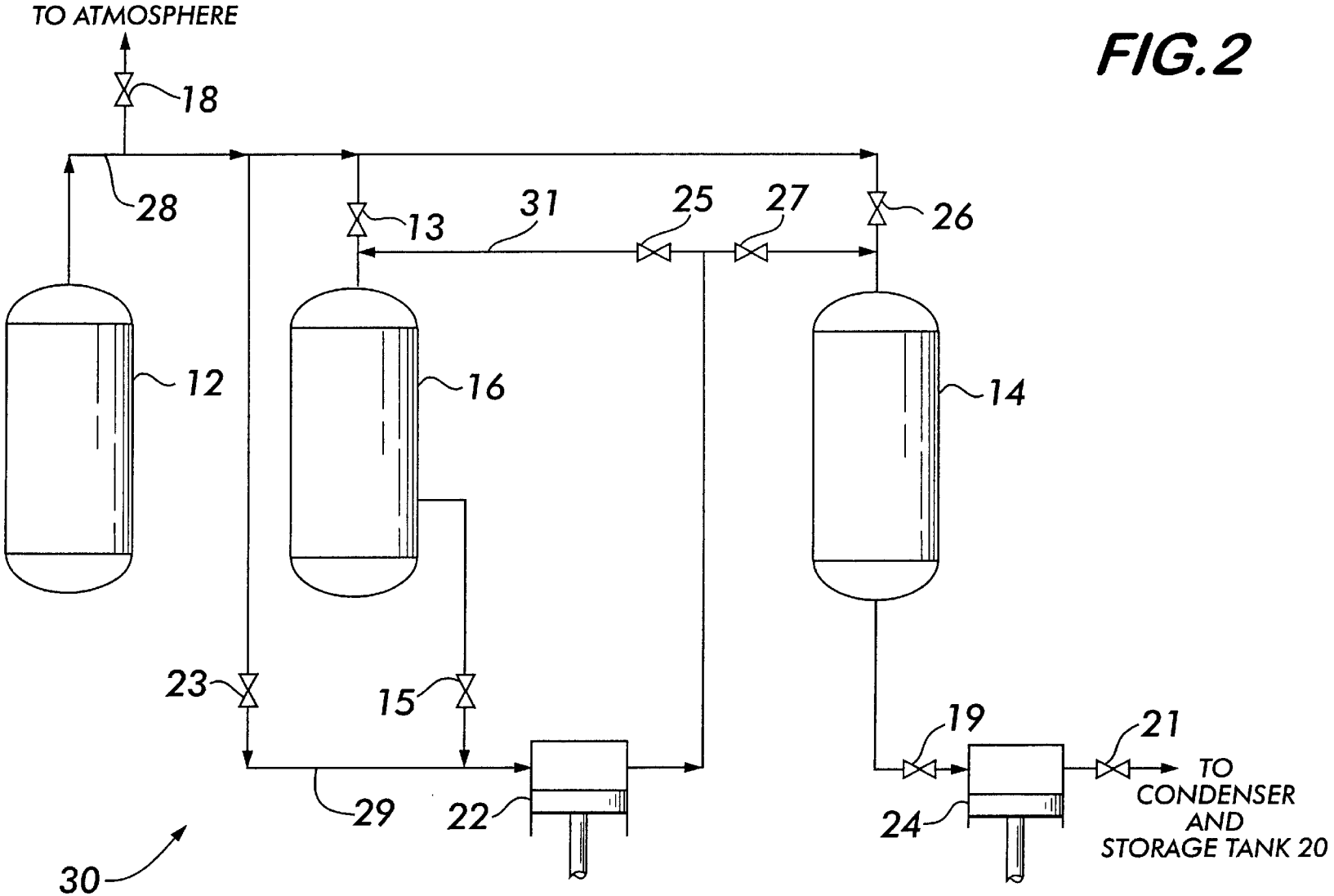
FIG. 2 is a schematic representation illustrating a process flow diagram for a carbon dioxide recovery method for one embodiment of the present invention used in the production of expanded tobacco.

By modifying the prior art method of depressurization and the equipment, in accordance with the first preferred embodiment of the present invention, as illustrated in FIG. 2, the carbon dioxide normally vented to the atmosphere(in the conventional process of FIG. 1) during the third depressurization step can instead be recovered for reuse. The recovery of this additional carbon dioxide results in lower production costs and reduced emissions to the environment.

The carbon dioxide recovery process 30 shown in FIG. 2 utilizes the low-pressure gas compressor 22 to reduce the pressure in the impregnation vessel 12 from the pressure at the end of the second depressurization step down to atmospheric pressure by pumping the remaining available carbon dioxide directly from the impregnation vessel to the low-pressure gas tank 16. This is achieved by the installation of valve 23 and line 29 that connect the impregnation vessel 12 directly to the suction side of the low-pressure gas compressor 22. The low-pressure gas compressor 22 pumps the carbon dioxide from the impregnation vessel 12 to the low-pressure gas tank 16 via valve 25 and line 31. When the impregnation vessel reaches atmospheric pressure, the vessel is opened, the product is discharged, and the expanded tobacco manufacturing process continues. The additional recovered carbon dioxide, now present in the low-pressure gas tank 16, is compressed and recovered in the normal sequence described above (for the prior art process shown in FIG. 1). This improved depressurization and carbon dioxide recovery process 30 illustrated in FIG. 2 can be implemented in any existing expanded tobacco plant.

In the impregnation vessel 12, the tobacco is submerged in liquid carbon dioxide at pressures between 29 and 32 bar gauge, saturating the tobacco cells. The excess liquid carbon dioxide is then drained from the impregnation vessel, leaving only the liquid carbon dioxide absorbed in the tobacco surrounded by its equilibrium gas. To form the expanding agent, $CO_2$ hydrate, in the tobacco it is necessary that the carbon dioxide molecules and the water molecules (in the tobacco) be cooled to produce the expanding agent. (As noted earlier, the "$CO_2$ hydrate" is referred to as the "expanding agent", while $CO_2$ is the "expansion agent", sometimes referred to as the "impregnant".)

The chemical formula for the $CO_2$ hydrate is $CO_2 \cdot 6\ H_2O$, and the chemical equation $$CO_2 + 6\ H_2O \underset{\text{- heat}}{\overset{\text{+ heat}}{\rightleftharpoons}} \text{equilibrium } CO_2 \cdot 6\ H_20$$

shows the reversible reaction of formation for the hydrate. In the prior art of the carbon dioxide expansion process, the required cooling for forming the hydrate is effected by vaporizing some of the liquid carbon dioxide absorbed in the tobacco by depressurizing the impregnation vessel 12 to the high-pressure gas tank 14 and low-pressure gas tank 16 in two stages, ending at a pressure well below the triple point (4.17 bar gauge) of carbon dioxide. If enough water is available in the tobacco (normally about 20% moisture on a wet weight basis), the hydrate can be formed during the depressurization all the way from the initial impregnation pressure down to the carbon dioxide triple point, if the rate of vaporization of the liquid carbon dioxide is sufficient to remove the heat of hydration from the tobacco/water/$CO_2$ matrix. The hydrate forms at a temperature somewhat higher (3 to 7° C.) than the freezing point of water at the same salinity. The hydrate formation reaction is exothermic and the heat of hydration (131.5 cal/gm of water hydrated) requires much more cooling to effect the reaction than the freezing of water would require (80 cal/gm of water frozen). If the cooling rate due to liquid carbon dioxide vaporization falls below the heat of hydration, some of the water will be frozen and will no longer be available for hydration.

In the two-stage depressurization of the carbon dioxide expansion process, as the valve 26 opens from the impregnation vessel 12 to the high-pressure gas tank 14 (see FIG. 1), the vaporization rate of the liquid carbon dioxide is very high, as the differential pressure between the impregnation vessel 12 and the high-pressure gas tank 14 is very high, producing sufficient cooling to produce good hydration. As the pressure in the impregnation vessel decreases and the pressure in the high-pressure gas tank increases, due to the flow towards the equilibrium pressure between the two vessels, the differential pressure reaches a point where the vaporization rate of the carbon dioxide is too low to form hydrate, but is still high enough to freeze water into ice. When the equilibrium pressure between the two vessels is reached, the second stage of depressurization begins. In the same manner, hydration occurs as the impregnation vessel 12 is vented to the low-pressure gas tank 16, vaporization decreases, water-ice forms, and the remaining carbon dioxide becomes dry ice at the triple point of carbon dioxide. The remaining gas in the impregnation vessel can be recovered or vented to the atmosphere via valve 18.

Using 20% moisture tobacco in the impregnation vessel 12, the theoretical maximum hydrate formation could be as high as 8.7% $CO_2$ as hydrate based on the wet weight of the tobacco if all of the available water were hydrated. Typical values for hydrate formation in the present embodiment of the process are in the range of 2 to 3% $CO_2$ as hydrate. Tobacco expansion is very poor if $CO_2$ as hydrate is less than 2.0%, and processing plants operating near the 3% level show better overall product quality.

Figure 3:
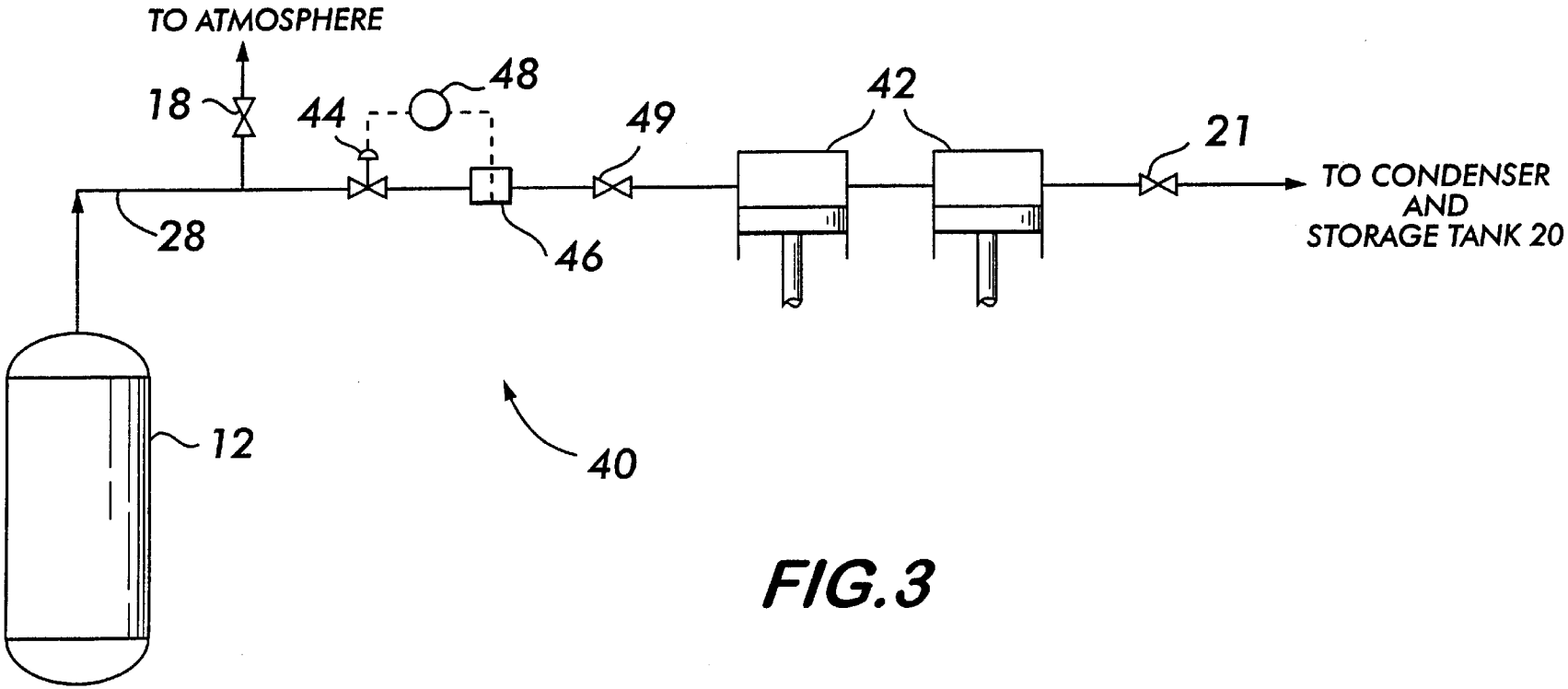
FIG. 3 is a schematic representation illustrating a process flow diagram for a carbon dioxide recovery process for another embodiment of the present invention used in the production of expanded tobacco.

A second preferred embodiment of the invention is illustrated in FIG. 3. This embodiment is applicable to existing processing plants as well as new or future processing plants, and is believed to be the method that provides the most efficient recovery of the carbon dioxide for depressurization of the impregnation vessel 12.

Referring to FIG. 3, it can be seen that this embodiment 40 uses a compression system comprised of a multi-stage or compound compressor 42 directly coupled to the impregnation vessel 12. (Persons skilled in the art will recognize that a combination of single-stage compressors in series, as well as other combinations of compression equipment, could be used in place of a multi-stage compressor.) The compression system is capable of compressing the carbon dioxide from one atmosphere to the pressure in the storage tank 20 (not shown), which is equal to the pressure sufficient to condense the expansion agent. (For carbon dioxide, this is about 35.5 bar gauge.) This arrangement eliminates the need for both the high-pressure gas tank 14 and the low-pressure gas tank 16. Coupling the compressor directly to the impregnation vessel does not preclude the installation of a separator vessel ("knockout pot") (not shown) between the impregnation vessel and the compressor. This separator vessel, if required, would remove any entrained tobacco dust from the gas stream.

Another important advantage of using a multi-stage or compound compressor 42 to depressurize the impregnation vessel 12 as shown in FIG. 3 is that the mass flow of the gas leaving the impregnation vessel can be controlled at whatever rate is sufficient for maximum hydration of the water in the tobacco. This requires the installation of a conventional flow control valve 44 in the line 28 exiting the impregnation vessel and a conventional differential flow metering device 46 installed between the control valve 44 and the suction line of the compound compressor 42. The flow control valve and the differential flow metering device are coupled together in a control loop using a conventional set-point controller 48. Persons skilled in the art will recognize that alternate arrangements are possible whereby the differential flow metering device 46 can be installed upstream of the control valve 44. Persons skilled in the art also will recognize that it is straightforward to determine the optimum depressurization mass flowrate for maximum hydrate formation over the full range of pressures of depressurization from the initial impregnation pressure to a pressure where the expansion agent ceases to form a water hydrate (which is the triple point of carbon dioxide when the expansion agent is carbon dioxide).

The optimum depressurization mass flowrate is determined using an iterative method, whereby the mass flowrate of the expansion agent is set at a selected value and the amount of expanding agent present in the impregnated product is determined by laboratory analysis at the end of the impregnation cycle. After this determination is made, the mass flowrate of the expansion agent is incrementally adjusted and the process is repeated. Subsequent adjustments of mass flowrate of the expansion agent are made until the maximum amount of expanding agent is found to be present in the impregnated product.

The elimination of the high-pressure and low-pressure gas tanks (14, 16) in this embodiment 40 reduces the hardware costs of the overall system. One multi-stage or compound compressor can be designed to handle up to three impregnation vessels, as the compressor would be in use for a maximum of approximately 300 seconds out of a total cycle time of approximately 1000 seconds.

Although various embodiments of the present invention have been discussed above, it will be appreciated that variations and modifications may be made to those embodiments without departing from the spirit and scope of the invention as defined in the appended Claims.

Without further elaboration, the foregoing will so fully describe and illustrate our invention that others may, by applying current and/or future knowledge, readily adopt the same for use under various conditions of service.

We claim:

1. A method for recovering additional expansion agent in a batch process for the expansion of tobacco or another agricultural product, the batch process having a multi-step depressurization sequence including at least first and second depressurization steps for depressurizing an impregnation vessel, comprising the steps of:

withdrawing substantially all of an amount of expansion agent in the impregnation vessel at about the end of the second depressurization step during the multi-step depressurization sequence of the batch process; and transmitting at least a portion of said amount of expansion agent to a low-pressure gas tank.

2. A method for recovering additional expansion agent as in claim 1, comprising the further steps of:

withdrawing at least a portion of the expansion agent from the low-pressure gas tank;

compressing the expansion agent withdrawn from the low-pressure gas tank;

transmitting the compressed expansion agent to a high-pressure gas tank;

withdrawing at least a portion of the compressed expansion agent from the high-pressure gas tank;

compressing further the compressed expansion agent withdrawn from the high-pressure gas tank;

condensing the further compressed expansion agent; and storing the condensed expansion agent in a storage tank.

3. A method as in claim 1, wherein the expansion agent is selected from the group consisting of carbon dioxide ($CO_2$), ethylene ($C_2H_2$), propylene ($C_3H_6$), cyclo propane ($C_3H_6$), propane ($C_3H_8$), iso-butane ($C_4H_{10}$), chlorine ($Cl_2$), hydrogen sulfide ($H_2S$), nitrogen ($N_2$), oxygen ($O_2$), methane ($CH_4$), acetylene($C_2H_2$), ethane ($C_2H_6$), methyl iodide ($CH_3I$), argon (A), arsine ($AsH_3$), bromine ($Br_2$), bromine chloride (Br Cl), chlorine dioxide (Cl $O_2$), hydrogen selenide ($H_2$ Se), krypton (Kr), methyl hydro sulfide($CH_3$ HS), nitrous oxide ($N_2O$), phosphine ($PH_3$), sulfur dioxide ($SO_2$), sulfur hexafluoride ($SF_6$), sulfuryl chloride ($SO_2$ $Cl_2$), stibine (Sb $H_3$), xenon (Xe), F-11 ($CCl_3$ F), F-12 ($CCl_2$ $F_2$), F-12B1 (CCl $F_2$ Br), F-13B1 (CBr $F_3$), F-20 (CH $Cl_3$), F-21 (CH $Cl_2$ F), F-22 (CH Cl $F_2$), F-30 ($CH_2$ $Cl_2$), F-31 ($CH_2$ Cl F), F-32 ($CH_2$ $F_2$), F-40 ($CH_3$ Cl), F-40B1 ($CH_3$ Br), F-142b ($CH_3$ CCl $F_2$), F-152a ($CH_3$ $CHF_2$), F-12B2 ($CF_2$ $Br_2$), F-22B1 (CH Br $F_2$), F-41($CH_3$ F), F-150a ($CH_3$ CH $Cl_2$), F-160 ($C_2H_5$ Cl), F-160B1 ($C_2H_5$ Br), F-161 ($C_2H_5$ F), and F-1140 ($CH_2$=CHCl).

4. A method for recovering additional expansion agent in a batch process for the expansion of tobacco or another agricultural product, the batch process having a means for depressurizing an impregnation vessel, comprising the steps of:

withdrawing substantially all of an amount of expansion agent in the impregnation vessel during the depressurization of the impregnation vessel;

transmitting, without collection, substantially all of said amount of expansion agent to at least one compressor; and compressing substantially all of said amount of expansion agent to a pressure sufficient to condense the expansion agent.

5. A method for recovering additional expansion agent as in claim 4, comprising the further steps of:

condensing the compressed expansion agent; and storing the condensed expansion agent in a storage tank.

6. A method for recovering additional expansion agent as in claim 4, comprising the further step of:

regulating a mass flow of said amount of expansion agent withdrawn from the impregnation vessel at a mass flow rate sufficient for maximum hydration of an amount of water in the tobacco or another agricultural product.

7. A method for recovering additional expansion agent as in claim 4, comprising the further step of:

determining an optimum depressurization mass flowrate for maximum hydrate formation over a range of pressures of depressurization from an initial impregnation pressure to a pressure where the expansion agent ceases to form water hydrate.

8. A method as in claim 7, wherein the step of determining an optimum depressurization mass flowrate comprises the following sub-steps:

(a) setting the mass flowrate of the expansion agent at a selected mass flowrate;

(b) determining an amount of expanding agent present in an impregnated product at about the end of an impregnation cycle;

(c) adjusting by an incremental amount the mass flowrate of the expansion agent; and (d) repeating sub-steps (b), (c) and (d) until a maximum amount of expanding agent is determined to be present in the impregnated product.

9. A method as in claim 4, wherein the expansion agent is selected from the group consisting of carbon dioxide ($CO_2$), ethylene ($C_2H_2$), propylene ($C_3H_6$), cyclo propane ($C_3H_6$), propane ($C_3H_8$), iso-butane ($C_4H_{10}$), chlorine ($Cl_2$), hydrogen sulfide ($H_2S$), nitrogen ($N_2$), oxygen ($O_2$), methane ($CH_4$), acetylene($C_2H_2$), ethane ($C_2H_6$), methyl iodide ($CH_3I$), argon (A), arsine ($AsH_3$), bromine ($Br_2$), bromine chloride (Br Cl), chlorine dioxide (Cl $O_2$), hydrogen selenide ($H_2$ Se), krypton (Kr), methyl hydro sulfide($CH_3$ HS), nitrous oxide ($N_2O$), phosphine ($PH_3$), sulfur dioxide ($SO_2$), sulfur hexafluoride ($SF_6$), sulfuryl chloride ($SO_2$ $Cl_2$), stibine (Sb $H_3$), xenon (Xe), F-11 ($CCl_3$ F), F-12 ($CCl_2$ $F_2$), F-12B1 (CCl $F_2$ Br), F-13B1 (CBr $F_3$), F-20 (CH $Cl_3$), F-21 (CH $Cl_2$ F), F-22 (CH Cl $F_2$), F-30 ($CH_2$ $Cl_2$), F-31 ($CH_2$ Cl F), F-32 ($CH_2$ $F_2$), F-40 ($CH_3$ Cl), F-40B1 ($CH_3$ Br), F-142b ($CH_3$ CCl $F_2$), F-152a ($CH_3$ $CHF_2$), F-12B2 ($CF_2$ $Br_2$), F-22B1 (CH Br $F_2$), F-41 ($CH_3$ F), F-150a ($CH_3$ CH $Cl_2$), F-160 ($C_2H_5$ Cl), F-160B1 ($C_2H_5$ Br), F-161 ($C_2H_5$ F), and F-1140 ($CH_2$=CHCl).

10. A method for recovering additional expansion agent in a process for the expansion of tobacco or another agricultural product, the process having a multi-step depressurization sequence including at least first and second depressurization steps for depressurizing an impregnation vessel, comprising the steps of:

withdrawing substantially all of an amount of expansion agent in the impregnation vessel at about the end of the second depressurization step during the multi-step depressurization sequence;

compressing at least a portion of said amount of expansion agent to a pressure sufficient to condense the expansion agent; and determining an optimum depressurization mass flowrate for maximum hydrate formation over a range of pressures of depressurization from an initial impregnation pressure to a pressure where the expansion agent ceases to form water hydrate.

11. A batch process for the expansion of tobacco or another agricultural product wherein the batch process includes a method for recovering additional expansion agent, the batch process having a multi-step depressurization sequence including at least first and second depressurization steps for depressurizing an impregnation vessel, comprising the steps of:

withdrawing substantially all of an amount of expansion agent in the impregnation vessel at about the end of the second depressurization step during the multi-step depressurization sequence of the batch process; and transmitting at least a portion of said amount of expansion agent to a low-pressure gas tank.

12. A batch process for the expansion of tobacco or another agricultural product wherein the batch process includes a method for recovering additional expansion agent, the batch process having a means for depressurizing an impregnation vessel, comprising the steps of:

withdrawing substantially all of an amount of expansion agent in the impregnation vessel during the depressurization of the impregnation vessel;

transmitting, without collection, substantially all of said amount of expansion agent to at least one compressor; and compressing substantially all of said amount of expansion agent to a pressure sufficient to condense the expansion agent.

13. A method for recovering additional expansion agent in a process for the expansion of tobacco or another agricultural product, the process having a multi-step depressurization sequence including at least first and second depressurization steps for depressurizing an impregnation vessel, comprising the steps of:

withdrawing substantially all of an amount of expansion agent in the impregnation vessel at about the end of the second depressurization step during the multi-step depressurization sequence;

compressing at least a portion of said amount of expansion agent to a pressure sufficient to condense the expansion agent; and determining an optimum depressurization mass flowrate for maximum hydrate formation over a range of pressures of depressurization from an initial impregnation pressure to a pressure where the expansion agent ceases to form water hydrate by (a) setting the mass flowrate of the expansion agent at a selected mass flowrate;

(b) determining an amount of expanding agent present in an impregnated product at about the end of an impregnation cycle;

(c) adjusting by an incremental amount the mass flowrate of the expansion agent; and (d) repeating (b), (c) and (d) until a maximum amount of expanding agent is determined to be present in the impregnated product.

* * * * *